US006206369B1

(12) United States Patent
Hoshii et al.

(10) Patent No.: US 6,206,369 B1
(45) **Date of Patent: *Mar. 27, 2001**

(54) SORTER

(75) Inventors: Osamu Hoshii; Teruo Komatsu; Yasuyoshi Hayakawa; Tsuyoshi Waragai, all of Mishima; Tomoyuki Araki, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 31 days.

(21) Appl. No.: 08/827,465

(22) Filed: Mar. 28, 1997

(30) Foreign Application Priority Data

Mar. 29, 1996 (JP) ..... 8-077713
Sep. 11, 1996 (JP) ..... 8-240148

(51) Int. Cl.[7] ..... B65H 39/10
(52) U.S. Cl. ..... 271/290; 271/297; 271/305
(58) Field of Search ..... 271/287–290, 271/291, 297, 300, 303, 305, 176, 189, 18, 139, 225

(56) References Cited

U.S. PATENT DOCUMENTS 4,494,748 1/1985 Miyashita et al. .
4,501,419 * 2/1985 Takahashi et al. ..... 271/288
5,104,118 4/1992 Hamanaka .
5,155,537 10/1992 Komatsu et al. .
5,292,116 3/1994 Inoue et al. .
5,348,284 9/1994 Ishihama et al. .
5,501,444 3/1996 Yukimachi et al. .

FOREIGN PATENT DOCUMENTS 87-11513 11/1986 (KR) .

OTHER PUBLICATIONS

M.A. Bartholet, et al., Sheet Distributors for Multibin Collators, *IBM Technical Disclosure Bulletin,* vol. 24, No. 7B, pp. 3768–3770, Dec. 1981.

* cited by examiner

*Primary Examiner*—Donald P. Walsh
*Assistant Examiner*—Brett C Martin
(74) *Attorney, Agent, or Firm*—Fitzpatrick, Cella, Harper & Scinto

(57) ABSTRACT

A sheet passage changing apparatus includes a plurality of swingable changing devices for changing a sheet transporting direction; common drivers for swinging the plurality of changing devices; a controller for actuating the drivers, before a sheet reaches an upstream one of the changing devices, to actuate the upstream one of the changing devices, thus changing the sheet transporting direction and for actuating the drivers, after the sheet passing through the upstream changing device and before the sheet reaches a downstream one of the changing device, to actuate the downstream changing device, thus changing the sheet transporting direction.

30 Claims, 13 Drawing Sheets

SORTER

FIELD OF THE INVENTION AND RELATED ART

The present invention relates to a switching apparatus for switching the direction in which a sheet is conveyed, and a sheet sorting apparatus comprising such a switching apparatus. More specifically, it relates to a sheet processing apparatus (sorter) which is employed in an image forming apparatus such as a copying machine, a printer, a facsimile machine, and the like, and allows the user to optionally sort sheets and deliver them into a plurality of delivery trays.

Recently, a typical image forming apparatus such as a copying machine, a printer, or a facsimile machine is equipped with a sheet processing apparatus which allows the user to optionally sort printed sheets and deliver them into a plurality of delivery trays.

This is for the following reason. In the case of an image forming apparatus such as a network printer or the like which is used by more than one person, it is feared that when a large number of printed sheets are delivered into a single tray, it is may become impossible to identify sets of sheets outputted for each user from among a large number of sheet sets accumulated on the delivery tray. Therefore, the sorter is enabled to allow the users to optionally sort the printed sheets into a plurality of delivery trays so that each set of printed sheets remains separated from the others.

In the case of a conventional sorter, it receives a printed sheet delivered from the main assembly of an image forming apparatus, and sorts it into a designated tray among a plurality of delivery trays, through a common sheet path. As it is well known, this type of sorter is employed in a medium to high speed copying machine which is normally used to make more than one copy, or in a large printer which is used to produce a large number of copies.

In some of the sheet processing apparatuses of the above described type, the delivery trays are fixedly disposed. More specifically, those sorters comprise a plurality of delivery trays, and a plurality of discharging roller pairs for discharging a sheet into the plurality of discharge trays, wherein the delivery trays and the discharging roller pairs are fixed to the main assembly of the sheet processing apparatus. Each delivery tray is mated with a sheet conveyance guide, a flapper, and a solenoid switch. The sheet conveyance guide forms a branch path for guiding a sheet from the aforementioned common sheet path to a delivery roller pair. The flapper allows the user to optionally switch the sheet delivery direction at the branching point. The solenoid switch drives the flapper.

However, in the case of a conventional sorter such as the one described above, the solenoid for driving the flapper which leads a sheet into a predetermined delivery tray is provided for each delivery tray, which increases cost. This is one of the problems of a conventional sorter.

Further, in recent years, the sorter market has been demanding a small and inexpensive apparatus which allows the user to randomly select the delivery trays during a continuous printing operation, and has a larger number of delivery trays than conventionally. However, it has been difficult for a conventional sorter to satisfy the demand for such a sorter, in terms of cost and size, since a conventional sorter must be provided with a flapper, a solenoid, or the like, for each delivery tray.

Further, as the number of the delivery trays is increased, the number of the solenoids must be increased to match the number of the delivery trays, which requires an increase in the number of electrical components for driving the solenoids, adding to the cost increase. In particular, in the case of a sheet processing apparatus, the cost of the actual sorting section greatly contributes to the overall (cost of a sheet processing apparatus. Therefore, the need for providing a solenoid switch for each delivery tray gives a conventional sorter a great disadvantage in terms of apparatus cost.

SUMMARY OF THE INVENTION

Accordingly, the primary object of the present invention is to suppress the cost or size increase which results from the increase in the number of delivery trays, so that it becomes possible to provide a highly reliable sheet processing apparatus capable of stably conveying a sheet.

According to a representative structure of the present invention which accomplishes the above object, a sheet processing apparatus capable of allowing the user to optionally sort a sheet into a plurality of delivery trays comprises: means for conveying a sheet; a common sheet path for conveying a sheet substantially in parallel to the direction in which the delivery trays are arranged; a member selectively pivotable between a position at which it guides a sheet to one of the delivery trays from the common sheet path and a position at which it does not block the common sheet path so that a sheet is guided along the common sheet path; means for conveying a sheet to the delivery trays after the direction in which the sheet is conveyed is switched by the pivotable member; a single means for pivoting a plurality of the pivotable members; means for linking the plurality of pivotable members to the single pivoting means; and a plurality of elastic members, each of which is disposed between the linking means and each of the plurality of pivotable members, wherein the single means for pivoting the plurality of pivotable members is structured so that when a sheet is in the sweeping area of one of the pivotable members, the pivotable member is held at a position at which it does not block the common sheet path.

According to the above structure, a sheet which is conveyed through the common sheet path is guided toward (sorted into) an optionally selected delivery tray by one of the plurality of pivotable members which are pivoted together by the single pivotable member pivoting means, through the linking means and the elastic members. When a pivotable member that is to sort a sheet is the one on the downstream side, of the two pivotable members that pivot together, the pivotable member on the upstream side remains at a position at which it does not block the common sheet path (more specifically, it does nothing to a sheet although it comes in contact with a sheet). Therefore, it does not interfere with sheet conveyance. In other words, even though the pivotable member on the upstream side is pivoted together with the pivotable member on the downstream side, a sheet is smoothly sorted by the pivotable member on the downstream side.

As described above, according to the present invention, when a sheet, which is being conveyed through a common sheet path to be sorted into a predetermined sorting path by a predetermined pivotable member among a plurality of pivotable members which are pivoted together by a single driving means, is in the sweeping area of one of the plurality of pivotable members, the pivotable members are held at positions at which they do not block the common sheet path. Therefore, a plurality of pivotable members can be driven by a single driving means, making it possible to reduce the number of the pivotable member driving means, and thereby making it possible to realize an inexpensive sorting apparatus which has a larger number of delivery trays into which a sheet can be randomly sorted.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, embodiments of the sheet processing apparatus in accordance with the present invention will be concretely described with reference to the drawings. In the following embodiments, the present invention will be described with reference to a sheet processing apparatus which is usable in an image forming apparatus such as a copying machine.

Embodiment 1

Figure 1:
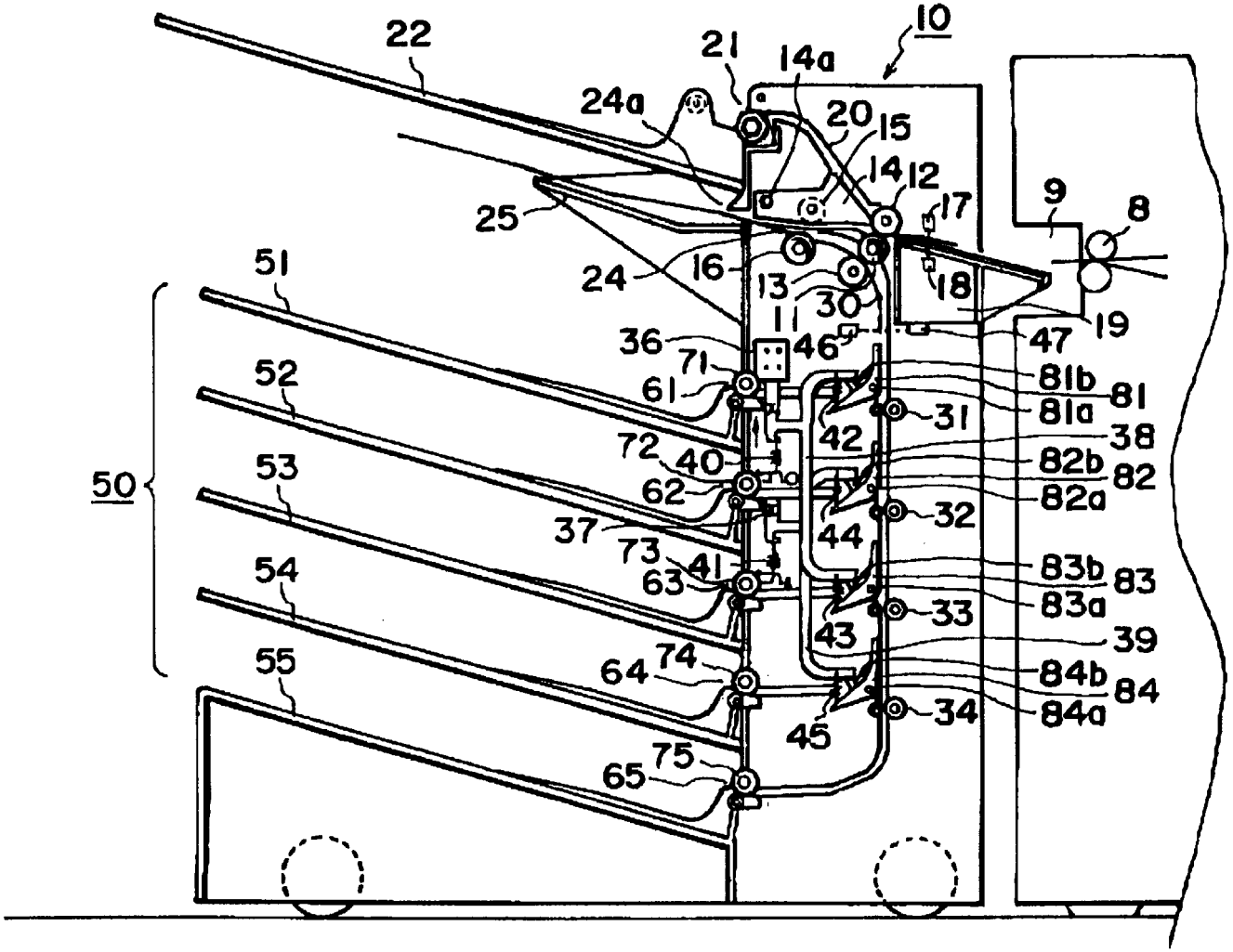
FIG. 1 is a vertical section of the sheet processing apparatus in the first embodiment of the present invention.
Figure 2:
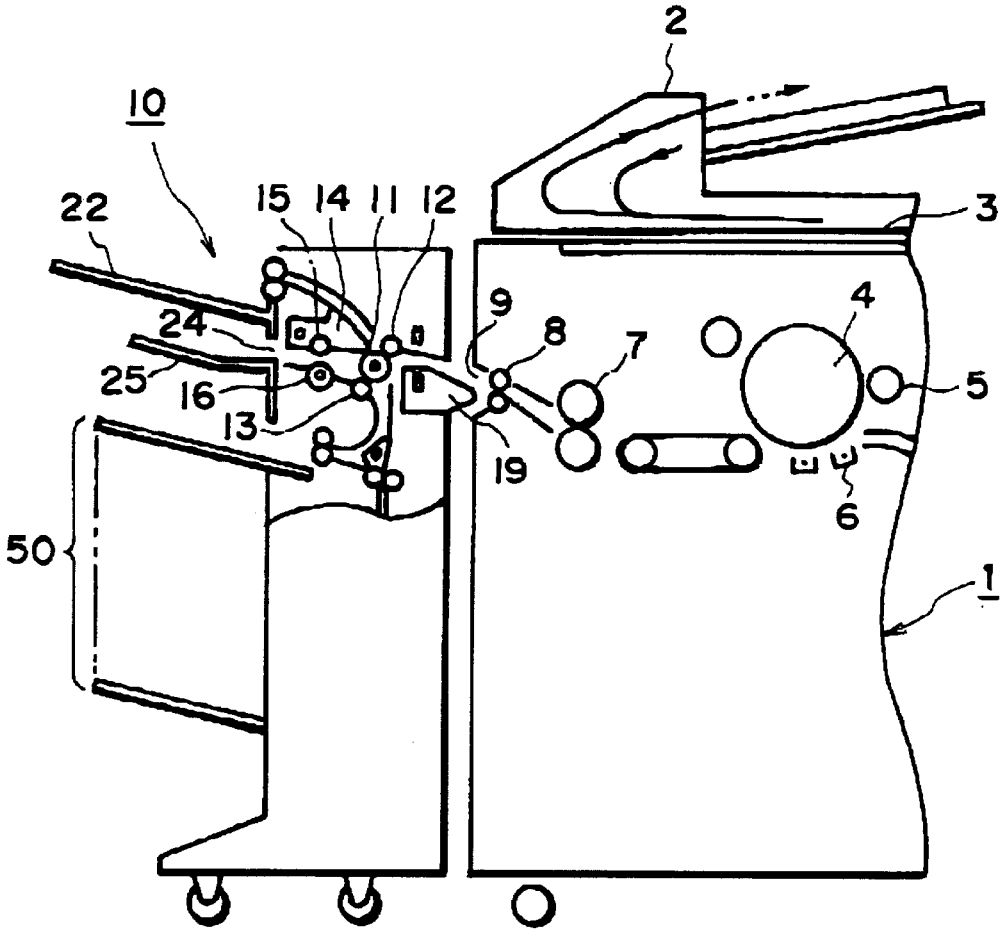
FIG. 2 is a schematic vertical section of an image forming apparatus equipped with the sheet processing apparatus illustrated in FIG. 2.

The first embodiment will be described with reference to FIGS. 1 and 2. FIG. 1 is a vertical section of the sheet processing apparatus in the first embodiment, and depicts the general structure thereof. FIG. 2 is a schematic vertical section of an image forming apparatus equipped with the sheet processing apparatus illustrated in FIG. 1, and depicts the general structure thereof.

First, referring to FIG. 2, the general structure of an image forming apparatus will be concisely described. As is illustrated in FIG. 2, on the top surface of an image forming apparatus 1, an automatic original feeding apparatus 2, which automatically circulates originals, is disposed. On the downstream side (left side of the drawing), a sheet processing apparatus, which comprises a face-up tray 22 and a plurality of face-down trays 50, is disposed.

The image forming apparatus 1 is an image forming apparatus employing one of the well-known electrophotographic systems, and its detailed description will be omitted at this time. The image of an original positioned on a platen glass 3 is formed on a photosensitive drum 4 by an unillustrated optical system. The formed image, a latent image, is visualized (as a toner image) by a developing device (or devices) 5 disposed around the photosensitive drum 4. The visualized image (toner image) is transferred from the photosensitive drum 4 onto a sheet of transfer material by a transferring device 6, and is permanently fixed to the transfer material by a fixing device 7.

Normally, the transfer sheets on which a permanent image was formed as described above are sequentially delivered into a face-up tray, with the printed surface facing upward, by a delivered roller pair 3. However, when image formation is carried out in the order of page number (for example, starting from the first page when copying a set of original which consists of 10 pages), and the finished copies are sequentially accumulated, with the printed surfaces facing upward, the copies are accumulated in the order opposite to the original page order. In order to accumulate the finished copies in the original page order, a sheet processing apparatus 10 of this embodiment, which is equipped with a sheet inverting mechanism such as the one illustrated in the drawing, is disposed adjacent to a copy delivery opening 9 of the image forming apparatus 1. With this arrangement, the finished copies can be accumulated in the same order as the original page order. More specifically, when an image forming operation is carried out in the order opposite to the original page order, the finished copies are sequentially deposited in the face-up tray 22, with their printed surfaces facing upward, and when an image forming operation is carried out in the sama order as the page order, the finished copies are sequentially turned over and deposited into one of the face-down trays 50, with their printed surfaces facing downward.

Next, referring to FIG. 1, the structure of the sheet processing apparatus in this embodiment will be described in detail. In FIG. 1, reference numerals 11, 12 and 13 designate conveyer rollers. In order to take in a sheet S and discharge it after turning it over, a plurality (two in this embodiment) of free-rolling rollers (rollers 12 and 13 in this embodiment) are disposed in contact with the peripheral surface of the conveyer roller 11, with a predetermined contact pressure, wherein the conveyer roller 11 is rotatable only in the direction indicated by an arrow mark. The conveyer roller 11, and roller 12 which is in contact with the conveyer roller 11 from above, constitute a take-in roller pair which takes in the sheet S, whereas the conveyer roller 11, and the roller 13 which is in contact with the conveyer roller 11 from below, constitute a discharge roller pair which discharges the sheet S. In other words, the sheet S is taken in by the conveyer roller 11 and the pressing roller 12, and is discharged by the conveyer roller 11 and the pressing roller 13.

A reference numeral 14 designates a flapper, which is disposed on the downstream side of the aforementioned take-in roller pair (11, 12). The flapper 14 is mounted on an axis 14*a*, being pivotable by an unillustrated pivoting means such as a solenoid about the axis 14*a*, so that it can be selectively pivoted between a position outlined by a solid line and a position outlined by a double dot chain line. In other words, whether or not a sheet S is conveyed into a plurality of sheet paths located on the downstream side of the conveyer roller 11 is determined by the selected position of the flapper 14. More specifically, as the position of the flapper 14 is switched to the position illustrated by the solid line in FIG. 1, the sheet S is guided into an inverting path 24. As the position of the flapper 14 is switched to the position outlined by the double dot chain line in FIG. 1, the sheet S is guided into a face-up delivery path 20, without being inverted, in other words, with the printed surface facing upward. Thus, the sheet S can be deposited with its printed surface facing upward or downward by selectively switching the position of the flapper 14.

In the face-up delivery path 20, a delivery roller pair 21 is disposed. The delivery roller pair 21 delivers the sheet S into the face-up tray 22 after the sheet S is conveyed to the delivery roller pair 21 through the face-up delivery path 20. The face-up tray 22 is removably attached to the main assembly of the apparatus 10, and accumulates and holds the sheet S sequentially delivered by the delivery roller 21.

A reference numeral 16 designates a reverse conveyer roller, which is continuously rotated in the direction (indicated by an arrow mark in the drawing) opposite to the rotational direction of the conveyer roller 11 to reversely convey a sheet S which is taken into the reversing path 24. The reverse conveyer roller 16 is disposed below a line which is drawn tangent to the take-in roller pair (11, 12), through the nip of the take-in roller pair (11, 12). Also, it is disposed closer to the take-in roller pair (11, 12) than to the leading end of the sheet S which has been taken in by the take-in roller pair (11, 12). Therefore, after the sheet S is guided into the reversing path 24 by the flapper 14 which has been moved to the position outlined by the solid line in FIG. 1, it is conveyed deeper into the reversing path 24 without contacting the reverse conveyer roller Further, the flapper 14 is provided with a roller 15 as a slave roller to the reverse conveyor roller 16. The roller 15 is rotatively attached to the flapper 14, opposing the reverse conveyer roller 16. As the flapper 14 is moved to the position outlined by the double dot chain line in FIG. 1, the roller 15 comes in contact with the reverse conveyor roller 16, and follow the rotation of the reverse conveyor roller 16. As the position of the flapper 14 is switched to the position outlined by the solid line in FIG. 1, the roller 15 becomes separated from the reverse conveyor roller 16, and remains separated.

After a sheet S is introduced into the reversing path 24 by the flapper 14 which has been moved to the position outlined by the solid line in FIG. 1, it is discharged onto an external reversing tray 25 from a temporary discharge opening 24*a*. During this movement of the sheet 5, the leading end of the sheet S does not touch the reverse conveyor roller 16. After this movement, the sheet S is temporarily exposed from the apparatus. The temporary discharge opening 24*a* is located between the face-up tray 22, and a face-down tray 51 which will be described later. With this arrangement, the sheet S temporarily exposed from the apparatus through the temporary discharge opening 24*a* is protected by both the trays 22 and 51, being prevented from being easily touched by the user. Therefore, the sheet S is prevented from being conveyed askew, or being damaged, by coming in contact with the user; the sheet S can be smoothly conveyed through the reversing path 24. Further, since the temporarily exposed sheet S can be hidden by the trays 22 and 51, the apparatus becomes more desirable in terms of its appearance when in operation.

The tray 25 disposed below the temporary discharge opening 24*a* prevents the temporarily discharged sheet S from coming in contact with another sheet S which has been already deposited in the face-down tray 51. With this arrangement, the sheets S which have been accumulated in the face-down tray 51 are prevented from becoming misaligned by coming in contact with the sheet S which would have come in contact with the sheets S if it were not for the face-down tray 51. Therefore, the sheets S on the face-down tray 51 can be kept in the desirable state of accumulation.

On the upstream side of the take-in roller pair (11, 12), a sensor (17, 18) is disposed as means for detecting the trailing end of a sheet S. As the trailing end of a sheet S is detected by the sensor (17, 18) during face-down delivery, the position of the flapper 14 is switched to the position outlined by the solid line in FIG. 1 by the unillustrated moving means such as a solenoid in response to the detection signal from the sensor (17, 18). As a result, the tip of the flapper 14 is moved from the nip of the take-in roller pair (11, 12) to the nip of discharge roller pair (11, 13).

The sheet S is nudged toward the reverse conveyor roller 16 by the downwardly pivoting flapper 14. In other words, as the position of the flapper 14 is switched to the position outlined by the double dot chain line in FIG. 1, the roller 15 attached to the flapper 14 comes in contact with the reverse conveyor roller 16, with the sheet S being pinched between the reverse conveyor roller 16 and the roller 15. As a result, the sheet S is conveyed toward the discharge roller pair (11, 13), that is, in the direction opposite to the direction in which it was taken in.

After being discharged from the reversing path 24 by the discharge roller pair (11, 13), the sheet S is guided into one of a plurality (five in this embodiment) of face-down delivery openings (openings 61–65) located on the downstream side of the discharge roller pair (11, 13), and then is deposited face down into one of the plurality (five in this embodiment) of face-down trays (trays 51–55), that is, the tray correspondent to the selected face-down delivery opening. For example, as a command is issued to discharge a sheet S into the uppermost face-down tray 51, a flapper 81 is moved from a position outlined by a solid line in FIG. 1 to a position. outlined by a double dot chain line in FIG. 1, whereby the sheet S is cumulatively delivered into the face-down tray 51 by a delivery roller pair 71 disposed adjacent to the uppermost delivery opening 61; the sheet S is cumulatively delivered, with the printed surface facing downward (in the order in which a sheet S is produced) as shown in FIG. 1.

Referring again to FIG. 1, a reference numeral 19 designates a guide member, which guides a sheet S to the nip of the take-in roller pair (11, 12) after the sheet S is delivered from a delivery opening 9 of the image forming apparatus 1. The guide member 19 is pivotable about the rotational axis of the conveyer roller 11, so that it can be aligned with the sheet delivery portion (position of discharge opening, nip of delivery roller pair, or the like) of an image forming apparatus. Therefore, the sheet processing apparatus in this embodiment can accommodate various image forming apparatuses which are different in the location from which a sheet S is delivered.

At this point in time, a case in which a plurality of sheets S are successively fed into the sheet processing apparatus, and are sequentially accumulated in the face-down tray 51 will be described. As the trailing end of the sheet S is detected by the sensor (17, 18), the flapper 14 is moved downward, as described above, with such timing that the sheet S begins to be guided by the flapper 14 toward the discharge roller pair (11, 13) as soon as the trailing end of the sheet S comes out of the nip of the take-in roller pair (11, 12). At the same time, the reverse conveyer roller pair (15, 16) pinches the sheet S, and begins to convey it to the discharge roller pair (11, 13).

Referring again to FIG. 1, the flapper 14 is structured so that its tip overlaps with the conveyer roller 11 as seen from the axial direction of the conveyer roller 11. Therefore, the sheet S can be efficiently conveyed by the friction which is caused between the conveyer roller 11 and the sheet S by the pressure from the flapper 14. Further, the flapper 14 functions as a guide for smoothly guiding the sheet S into the nip of the discharge roller pair (11, 13). It should be noted here that when the flapper 14 is disposed in such a manner that as the flapper 14 is pivoted to the bottom side position (position outlined by double dot line), the tip of the flapper 14 goes down below the rotational axis of the conveyer roller 11, and therefore, the sheet S can be more smoothly guided to the nip of the discharge roller pair (11, 13) without allowing the leading end (trailing end before inversion) of the sheet S to strike the conveyer roller 11.

More specifically, after coining out of the nip of the take-in roller pair (11, 12), the trailing end of the sheet S is pressed against the conveyer, roller 11 by the tip of the pivotable flapper 14, and therefore, even after it comes out of the nip of the discharge roller pair (11, 13), it is still conveyed in the same direction as the direction in which it came out of the nip, by the friction between the conveyer roller 11 and itself. This conveyance of the sheet S lasts until the friction between the conveyer roller 11 and the sheet S disappears, that is, until the trailing end of the sheet S passes through the contact area between the conveyer roller 11, and the tip of the flapper 14 located at the bottom side position (position outlined by the double dot chain line). As the trailing end of the sheet S comes out of the aforementioned contact area, the flapper 14 comes down further. The trailing end of the sheet S clears the conveyer roller 11 before the sheet S begins to be pinched and conveyed in the reverse direction by the reverse conveyer roller pair (15, 16), and therefore, it is smoothly guided to the nip of the discharge roller pair (11, 13).

As the leading end (trailing end before reversing) of the sheet S is pinched by the discharge roller pair (11, 13), the flapper 14 is pivoted upward, separating the slave roller 15 from the reverse conveyor roller 16. At this moment, the leading end of the following sheet is pinched by the take-in roller pair (11, 12) to be guided to the reversing path 24. Therefore, the following sheet is guided to the temporary discharge opening 24*a* along the top surface (printed surface) of the preceding sheet S, without coming in contact with the reverse conveyor roller 16. As the trailing end (leading end before reversing) of the preceding sheet cores out of the nip of the discharge roller pair (11, 13), the trailing end of the following sheet is detected by the sensor (17, 18). Then, the aforementioned sheet movement reversing operation is started again as soon as the trailing end of the following sheet comes out of the nip of the take-in roller pair (11, 12).

Thus, the sheets which are continuously taken in can be reliably conveyed at a high speed in the direction reverse to their incoming direction, making it possible to provide a sheet processing apparatus which is particularly suitable for a high speed image forming apparatus. Further, the conveyor roller 11 or the reverse conveyor roller 16 is continuously rotated only in one direction; in other words, the complicated driving mechanism and driving control system, which are necessary in a conventional apparatus to rotate the rollers forward or backward, are unnecessary. Therefore, the present invention can provide an inexpensive apparatus.

Next, referring to FIG. 1, the mechanism for sorting sheets into predetermined face-down trays will be described in detail in terms of its structure. In this embodiment, the present invention is described with reference to a sheet processing apparatus which has five face-down trays as illustrated in FIG. 1. However, the application of the present invention is not limited to the apparatus in this embodiment; the number of the trays may be adjusted as necessary.

First, referring to FIG. 1, the general structure of the sheet processing apparatus 10 will be described. In FIG. 1, each of reference numerals 51–55 designates a delivery tray (face-down tray), in which the sheets discharged from the delivery opening are cumulatively held. Each of reference numerals 71–75 designates a delivery roller pair as a sheet delivery means, which is disposed for each delivery tray to deliver a sheet into the tray. A reference numeral 30 designates a common sheet path, through which the sheets taken in after a recording operation are vertically conveyed to a predetermined sorting portion (portion at which a path leading to one of the trays branches off from the common sheet path). It is a sheet conveying path which leads from the sheet entrance of the sheet processing apparatus 10 to the delivery roller pair 75 located most downstream, and is substantially parallel to the direction in which the trays are aligned. Along the common sheet path 30, conveyer roller pairs 31–34 as conveying means are disposed with predetermined intervals A sheet is vertically (downward direction in FIG. 1) conveyed through the common sheet path 30 by these conveyer roller pairs 31–34. Each of reference numerals 81–84 designates a flapper, an pivotable member, which guides a sheet to one of the delivery roller pairs 71–74, which is optionally selectable by the user. The rotational centers of the flappers 81–84 are located on the sheet delivery opening side, relative to the common sheet path 30, and are pivotable between a position at which they do not block the common sheet path (position outlined by the solid line in the drawing), and a position at which they block the common sheet path 30 (position outlined by the double dot chain line in the drawing). The conveyer roller pairs 31–34 are disposed immediately after (downstream side) the correspondent flappers 81–84, relative to the sheet conveyance direction in the common sheet path 30.

Next, the flapper movement during a sheet sorting operation will be described. Each of reference numerals 36 and 37 designates a solenoid, as means for moving the flapper, which selectively pivots the flappers 81–84. The solenoid 36 pivots the flappers 81 and 83, and the solenoid 37 pivots the flappers 82 and 84. They are independently fixed to the frame (unillustrated) of the sheet processing apparatus 10. Reference numerals 38 and 39 reach designates a link, as connecting means. They are connected to the moving portions of the solenoid 36 and 37, respectively, to be moved with the moving portion of the solenoids. They are movable only in the vertical direction FIG. 1. Reference numerals 40 and 41 each designates a tension spring, one end of which is anchored to the hook portion of the link, and the other end of which is anchored to a hook portion integrally formed with the apparatus frame. Reference numerals 42–45 designate a tension spring as an elastic member. The tension springs 42 and 43 connect the hook portions of the link 38 which is connected to the solenoid 36, to the hook portions of the flappers 81 and 83, respectively, and the tension springs 44 and 45 connect the hook portions of the link 39 which is connected to the solenoid 37, to the hook portions of the flappers 82 and 84, respectively.

FIG. 1 depicts a state in which the solenoids are off. When the solenoids 36 and 37 are off, the links 38 and 39 remain at the bottom positions due to the tensional force of the tension spring. In this state, the flappers 81–84 are at the positions (position outlined by the solid line in the drawing) at which they do not block the common sheet path 30. This is because the projections 81*b*, 82*b*, 83*b* and 84*b*, which are formed so as not to intrude into the sheet path, are pushed downward by the end portion of the links 38 and 39, that is, the and portions adjacent to the hook portions, and therefore, the flappers 81–84 are pivoted in the counterclockwise direction about the axes 81*a*, 82*a*, 83*a* and 84*a*. More specifically, as the solenoid 36 (or 37), for example, is turned on, the link 38 (or 39) is pulled up (in the direction indicated the arrow mark ),and therefore, the flappers 81 and 83 (or 82 and 84) are pivoted in the clockwise direction by the tensional force of the tension spring 42 and 43 (or 44 and 45) to be moved to the position (position outlined by the broken line) at which they block the common sheet-path 30.

Next, a series of operations which are carried out by the apparatus while a sheet is guided to the sheet delivery opening 64 by the fourth flapper 84 will be described. A sheet, an which an image has been recorded by the image forming apparatus 1, is transferred to the sheet processing apparatus 10. After the direction in which the sheet is conveyed is reversed, the leading end (trailing end before reversing) is detected by the sensor (46 and 47) at the entrance to the common sheet path 30. Then, the sheet is conveyed downward from the top end of the common sheet path 30 at a predetermined speeds by the conveyer roller pairs 31, 32 and 33. Based on the detection signal from the sensor (46, 47), the solenoid 37 is turned on with such timing that allows the leading end of the sheet to reach the conveyer roller pair 33 located immediately after the third flapper 83. As the solenoid 37 is turned on, force is applied to the link 39 in the direction to pull it up. Consequently, force is applied to the flappers 82 and 84 in the direction to pivot them in the clockwise direction. However, the tensional force of the tension spring 45, which connects the second flapper 82 and the link 39, is set to be sufficiently greater than the resistive force which opposes the upward pivoting of the flapper 82, but less than the bending resistance of a sheet. Therefore, only as the tip of the flapper 82, which is in the process of pivoting to the position at which the second flapper 82 blocks the common sheet path 30, comes in contact with a sheet which is being conveyed through the common sheet path 30, the tension spring 45 is stretched by the sheet whose bending resistance is greater than the tensional force of the tension spring 45. As a result, the flapper 82 is stopped, remaining in contact with the sheet, at a position at which it has come in contact with the sheet, without blocking the common sheet path 30. On the other hand, the fourth flapper 84 is pivoted to the position at which it blocks the common sheet path 30. Then, as the sheet is conveyed further downward by the conveyer roller pair 33 disposed along the common sheet path 30, it collides with the flapper 84. The direction in which force is applied to the flapper 84 by the leading and of the sheet when the sheet collides with the flapper 84 is such that the flapper 84 is pivoted in the clockwise direction. Therefore, the sheet is reliably guided toward the fourth delivery roller pair 74, by which the sheet is delivered into the fourth delivery tray 64. During the above series of operations, a sheet rubs against the free end portion of the flapper 82. However, the free end portion (portion which comes in contact with a sheet) of each flapper is rounded as illustrated in the drawing, and therefore, a sheet is smoothly conveyed downward, rubbing against the free end portion of the flapper without becoming hung up on it, by the conveyer roller pair located immediately after the flapper.

Figure 3:
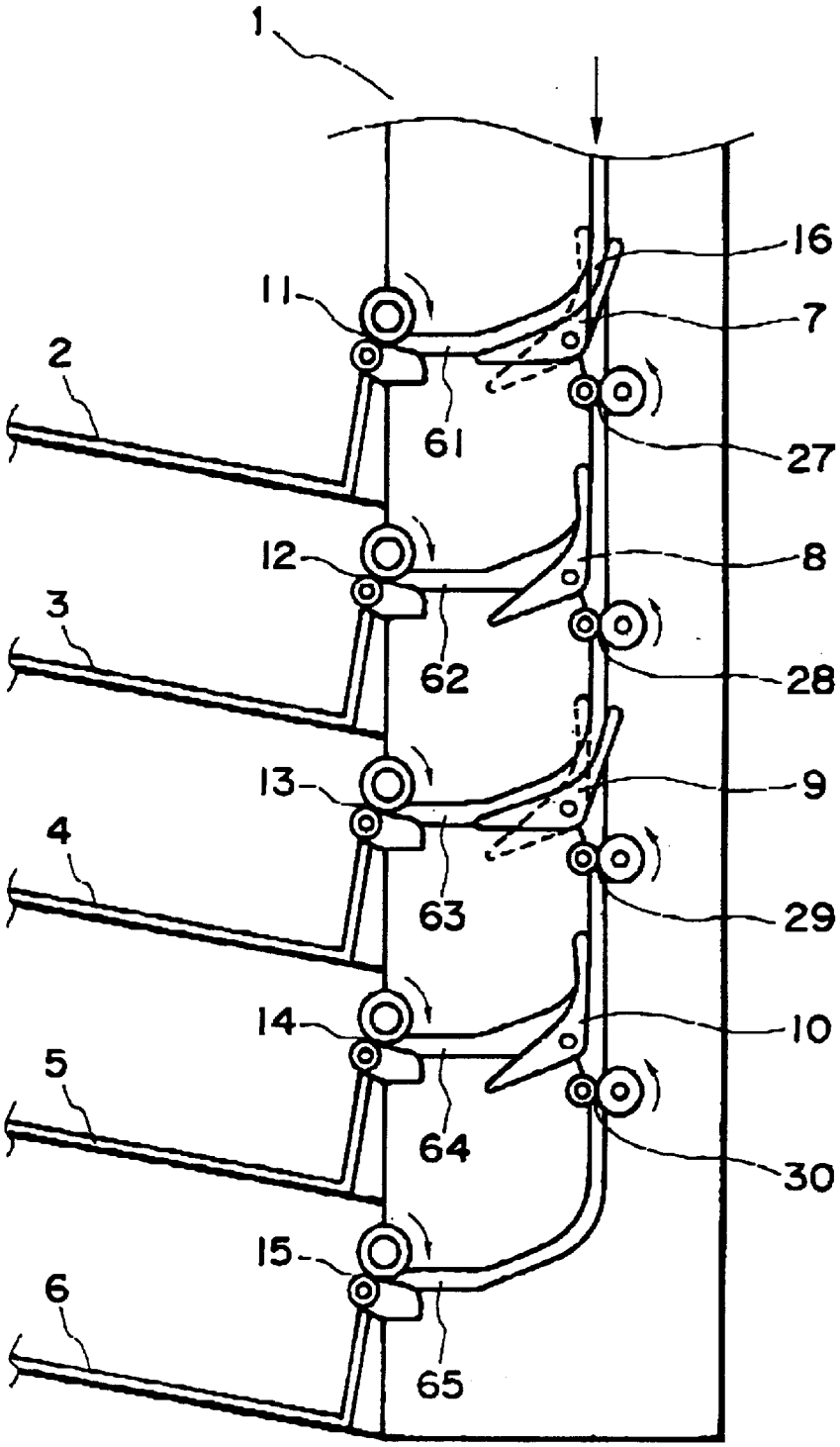
FIG. 3 is an enlarged vertical section of the flappers and their adjacencies in the sheet processing apparatus in the first embodiment of the present invention.

A detailed description will not be given here. However, as is illustrated in FIG. 3, the same description as the above can also be said about the series of operations through which a sheet is guided to the sheet delivery opening 63 by the third flapper 83. As for the tensional forces of the tension springs 42–44, they are set to be the same as the tensional force described above. As for the shapes of the free end portions of the flappers 81, 83 and 84, they are also rounded as is that of the flapper 82.

In the case of an apparatus structured as described above, in order to discharge a sheet into the bottom most delivery tray 55, it is only necessary to move none of the flappers (to keep solenoid 36 and 37 in the OFF state). A sheet is guided to a sheet delivery opening 65 through the common sheet path 30, and is cumulatively discharged into the delivery tray 55 by the delivery roller pair 75.

Further, in a case in which an apparatus is structured to move two flappers by a single solenoid so that a sheet is guided toward the deliverer roller side by the third or fourth flapper as described above, the sheet rubs against the first or second flapper as it is conveyed. In order to prevent a sheet from becoming restrained as it rubs against the first or second flapper, each of the conveyer roller pairs 31–34 disposed along the common sheet path 30 is to be provided with sheet conveying force sufficiently greater than the aforementioned frictional resistance.

As described above, according to this embodiment, the flappers 81–84 are connected by the tension springs 42–45, to the links 38 and 39 which are connected to the solenoids 36 and 37, respectively. Therefore, even though the plurality of flappers are moved by the single solenoid, a sheet is not restrained by the flappers other than the one which has been selected to sort the sheet (flapper which blocks common sheet path). Therefore, the cost and size increase of a sheet processing apparatus, which occurs as the number of delivery trays is increased, can be minimized as much as possible. As a result, it becomes possible provide a highly reliable sheet processing apparatus capable of stably, conveying a sheet.

In order to sort a sheet with the downstream side flapper, relative to the sheet conveyance direction, while pivoting two adjacent flappers by a single solenoid as in the second and third embodiments which will be described later, the flapper movement must be completed between the time when a sheet P leaves the conveyer roller pair located after the preceding flapper, and the time when the sheet P reaches the flapper which is to sort the sheet P.

In a case in which the sheet processing apparatus 1 is connected to an image forming apparatus whose sheet conveying speed is fast, the pivoting of the flapper sometimes fails to be completed within the above described period. In order to prevent the occurrence of such an incident, the two flappers which are pivoted by the same solenoid are alternately disposed.

According to the fourth embodiment, two flappers can be pivoted by a single solenoid even when the sheet conveying speed of an image forming apparatus is high.

Embodiment 2

Figure 4:
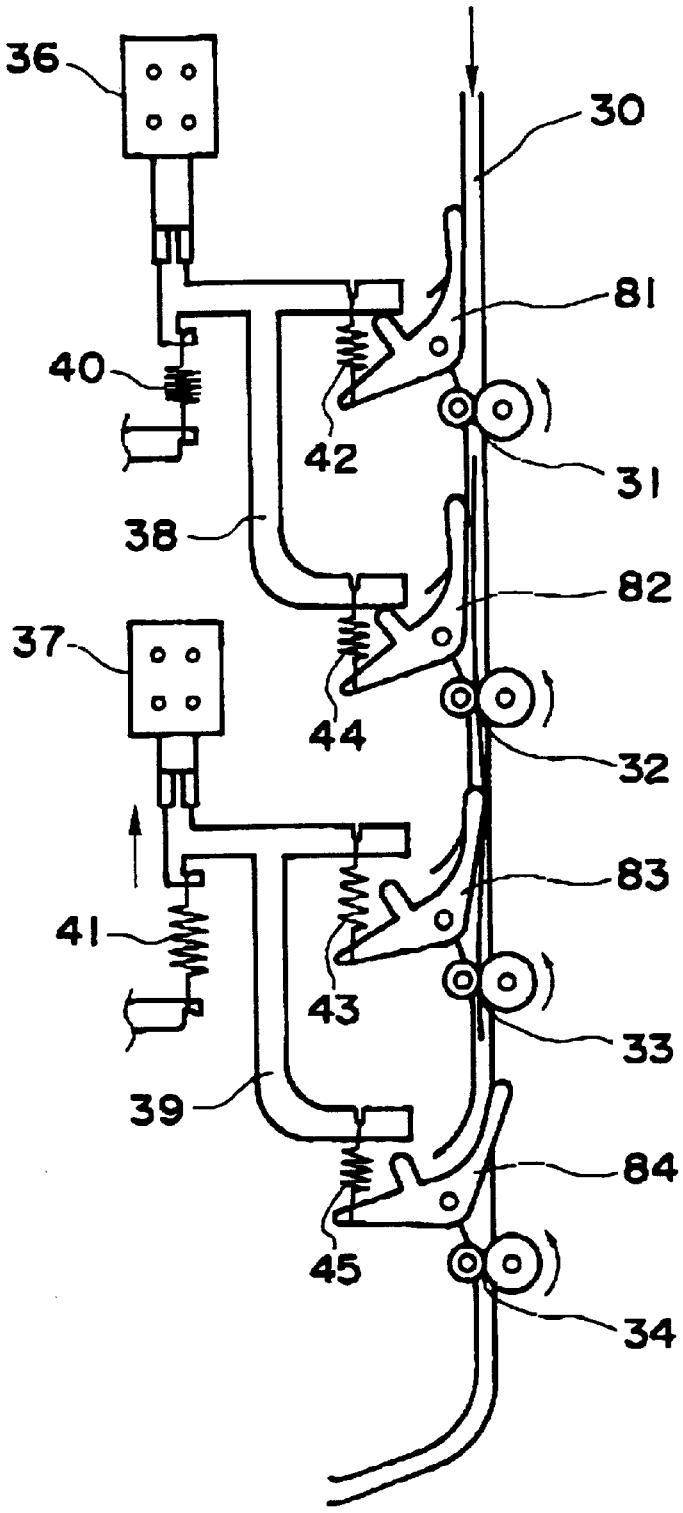
FIG. 4 is a vertical section of the essential portion of the sheet processing apparatus in the second embodiment of the present invention.
Figure 5:
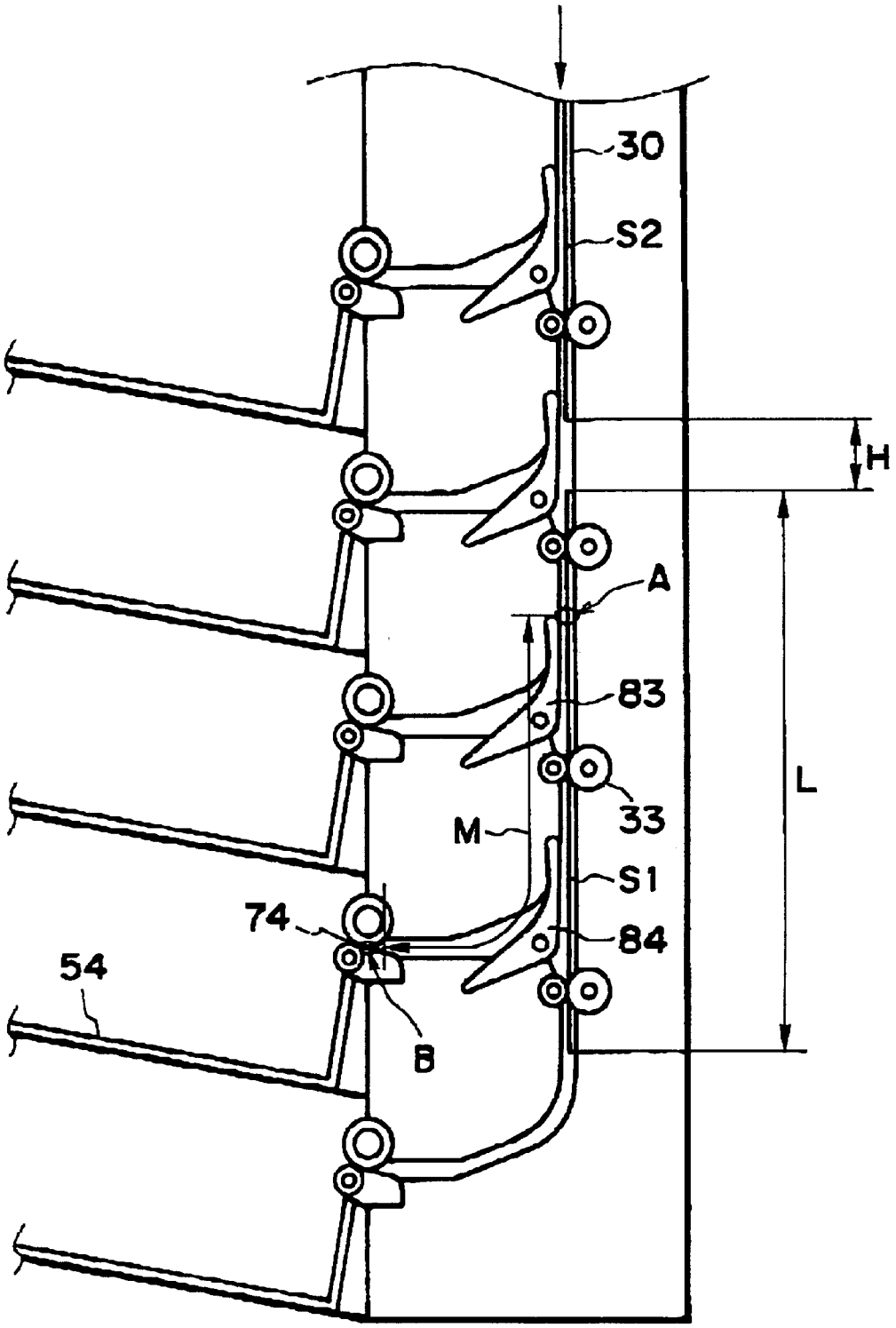
FIG. 5 is a vertical section of the essential portion of the sheet processing apparatus in the second embodiment of the present invention.

Referring to FIGS. 4 and 5, the sheet processing apparatus in the second embodiment will be described. FIGS. 4 and 5 are enlarged sections of the essential portion of the sheet processing apparatus in this embodiment. Since the general structure of the apparatus is substantially the same as that in the first embodiment, the members and portions having the same functions as those in the first embodiment are designated by the same referential symbols, and their detailed descriptions will be omitted here.

Referring to FIG. 4, the structure of the sheet processing apparatus in this embodiment is substantially the same as the structure described in the first embodiment. They are different only in how the solenoids 36 and 37 are combined with the flappers 81–84 which are to be pivoted by the solenoid 36 or 37. More specifically, the first and second flappers 81 and 82 are pivoted by the solenoid 36, and the third and fourth flappers 83 and 84 are pivoted by the solenoid 37.

In the case of a sheet processing apparatus structured as described above, in order to deliver a sheet into the fourth tray, the solenoid 37 is turned on to move the link 39, and the flapper 83 and 84 are pivoted at the same time (to the position at which they block the common sheet path 30). During this operation, as described in the preceding embodiment, the fourth flapper 84 pivots to the position (outlined by a solid line in FIG. 3) at which it blocks the common sheet path 30, whereas the third flapper 83 stops as it comes in contact with a sheet which is being conveyed, being pinched, by the conveyer roller pair 33. Then, the sheet is conveyed further by the conveyer roller 33, being guided by the fourth flapper 84, and is delivered into the fourth delivery tray 54 by the fourth delivery roller 74 illustrated in FIG. 5.

In other words, in the first embodiment described above, a plurality of flappers to be moved at the same time by a single solenoid are alternate ones, whereas in this embodiment, a plurality of flappers to be moved at the same time by a single solenoid are consecutive ones, which also can provide the same effects as those described in the preceding embodiment.

Next, referring to FIG. 5, the requirements for the flappers movable by the same solenoid will be described. The requirements will be described with reference to a case in which the third and fourth flappers 83 and 84 are moved by the same solenoid 37 (FIG. 4). In FIG. 5, an alphabetic reference L stands for the measurement of the smallest conveyable sheet, relative to the sheet conveyance direction, and an alphabetic reference H stands for the interval between two smallest conveyable sheets S1 and S2 which are being consecutively conveyed. The distance between a position A, to which the flapper 83, that is, the one located on the upstream side, of the flappers 83 and 84 moved by the solenoid 37, is moved to block the common sheet path 30, and a position B, that is, the position of the delivery roller 74 at which a sheet arrives after it is guided toward the sheet delivery opening by the flapper 84 located on the downstream side, is designated by an alphabetic reference M. In this case, the positional relationship among the flappers movable by the same solenoid must be such that the sheet conveyance distance M becomes less than (L+H), that is, the sum of the length L of the smallest conveyable sheet and the minimum sheet interval H. In other words, in this embodiment, the flappers 83 and 84 movable by the solenoid 37 are disposed in a manner to satisfy the above described positional relationship.

Embodiment 3

Figure 6:
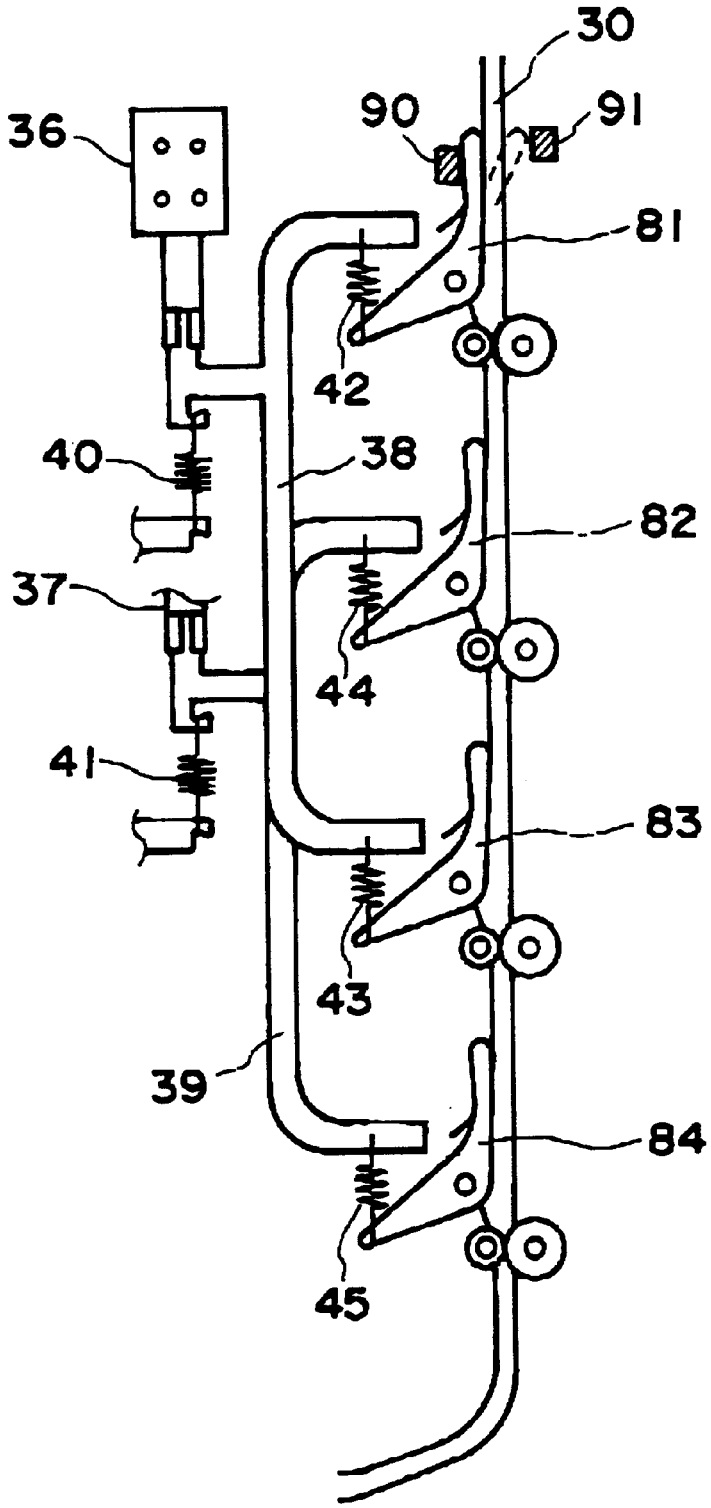
FIG. 6 is a vertical section of the essential portion of the sheet processing apparatus in the third embodiment of the present invention.
Figure 7:
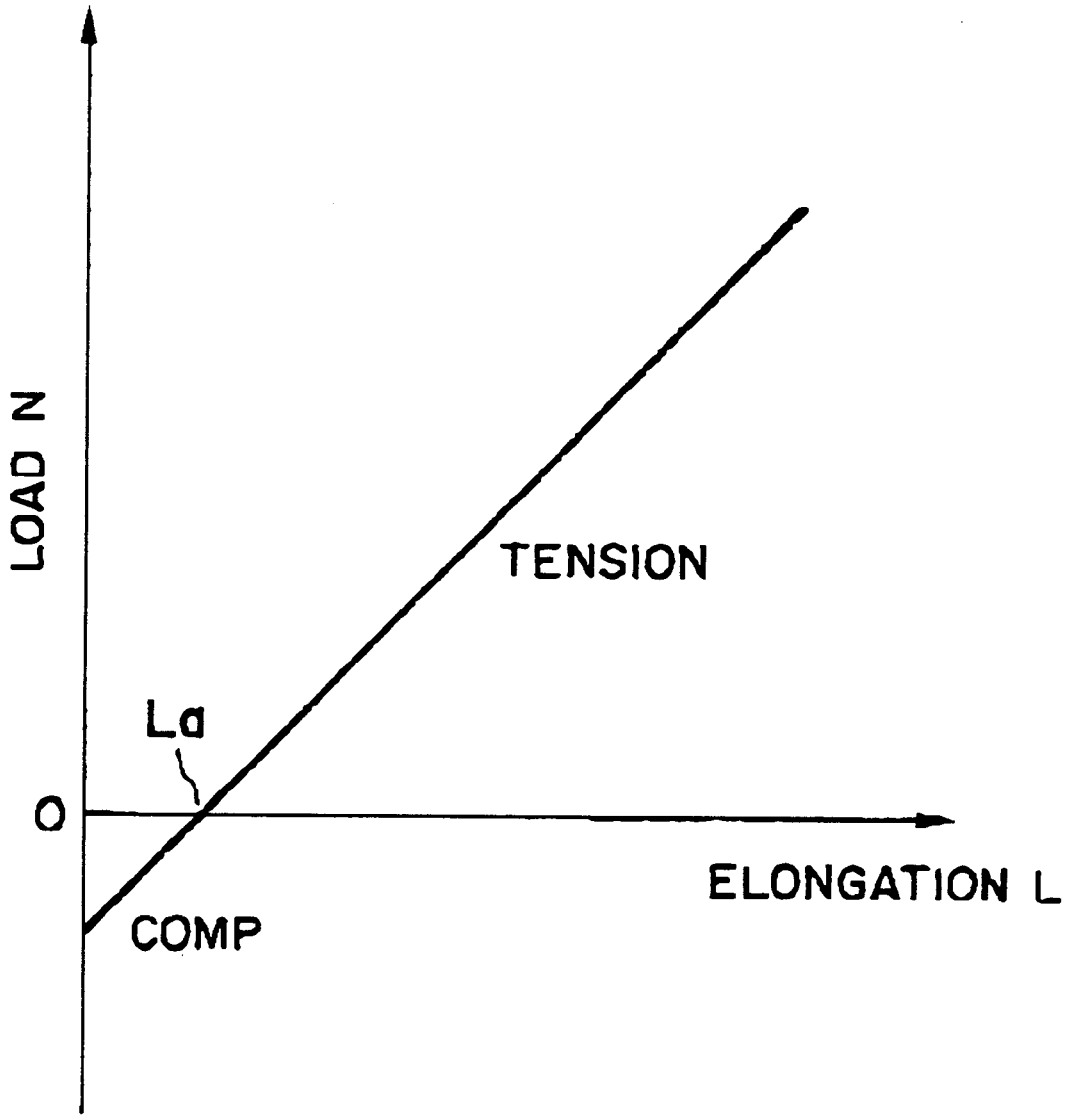
FIG. 7 is a graph which depicts the characteristics of the tension spring of the sheet processing apparatus in the third embodiment of the present invention.

Referring to FIGS. 6 and 7, the sheet processing apparatus in the third embodiment of the present invention will be described. FIG. 6 is an enlarged section of the essential portion of the sheet processing apparatus in this embodiment, and FIG. 7 is a graph depicting the characteristics of a tension spring. Since the general structure of the entire apparatus is substantially the same as that in the first embodiment described above, the members and portions having the same functions as those in the first embodiment are given the same referential symbols, and their detailed description will be omitted here.

Referring to FIG. 6, the sheet processing apparatus in this embodiment is substantially the same in structure as that in the first embodiment described above. It is different in the configurations of the links 38 and 39 moved by the solenoids 36 and 37, in the configurations of the flappers 81–84, and in the characteristic of the tension springs 42–45.

More specifically, referring to FIG. 7, the installation of the tension springs 42–45 is such that their tensional forces become zero when L, a distance by which they are elongated, is La; when L is less than La, compressive force is generated, and when L is greater than La, tensile force is generated. The flappers 81–84 are connected to the links 38 and 39 by the tension springs 42–45. Referring to the flapper 61, when the solenoid 36 is off, this flapper 81 stops at a predetermined position outlined by a solid line, with the elongation of the tension spring 42 being La, and when the solenoid 36 is on, the flapper 81 stops at a predetermined position outlined by a broken line, with the elongation of the tension spring 42 remaining at La. The provision of stoppers 90 and 91 at the predetermined stopping positions, respectively, makes the flapper 81 stop more accurately.

Although this is not illustrated, when the stoppers 90 and 91 are provided in the manner described above, similar stoppers are provided at the stopping position for each of the flappers 82–84.

Next, the sorting operation of a sheet processing apparatus structured as described above will be described. In this embodiment, the flappers 81–84 remain pivotable in both directions regardless of solenoid activation. More specifically, when the flapper 81 is pivoted while a sheet is in the common sheet path 30, its rotation stops due to the tensional force as the tip of the flapper 81 contacts the sheet. Further, when the solenoid is turned off as soon as the leading end of the sheet begins to be guided toward the sheet discharge opening, the flapper 81 rotates in the counterclockwise direction, and stops as the tip of the flapper 81 contacts the sheet, due to the compressive force of the tension spring 42. Here, even though the flapper movement is described with reference to the flapper 81, the same can be said about the movements of the flappers 82–84.

With the flappers 81–84 being retained at neutral positions by the correspondent tension springs 42–45, the flappers 81–84 have to be moved only when the leading end of a sheet is immediately before the flappers. Therefore, the structural restriction, which is required in the first embodiment in terms of sheet size and the like (flapper position, conveyance path length, and the like), can be eliminated. In other words, it becomes unnecessary to elaborately change the flapper moving timing.

Further, since the flapper solenoid can be turned off as soon as a sheet is guided into one of the sheet delivery branches, solenoid duty may be reduced. In other words, it becomes possible to employ inexpensive solenoids. Therefore, it is possible to provide an apparatus with far smaller cost.

Embodiment 4

Figure 8:
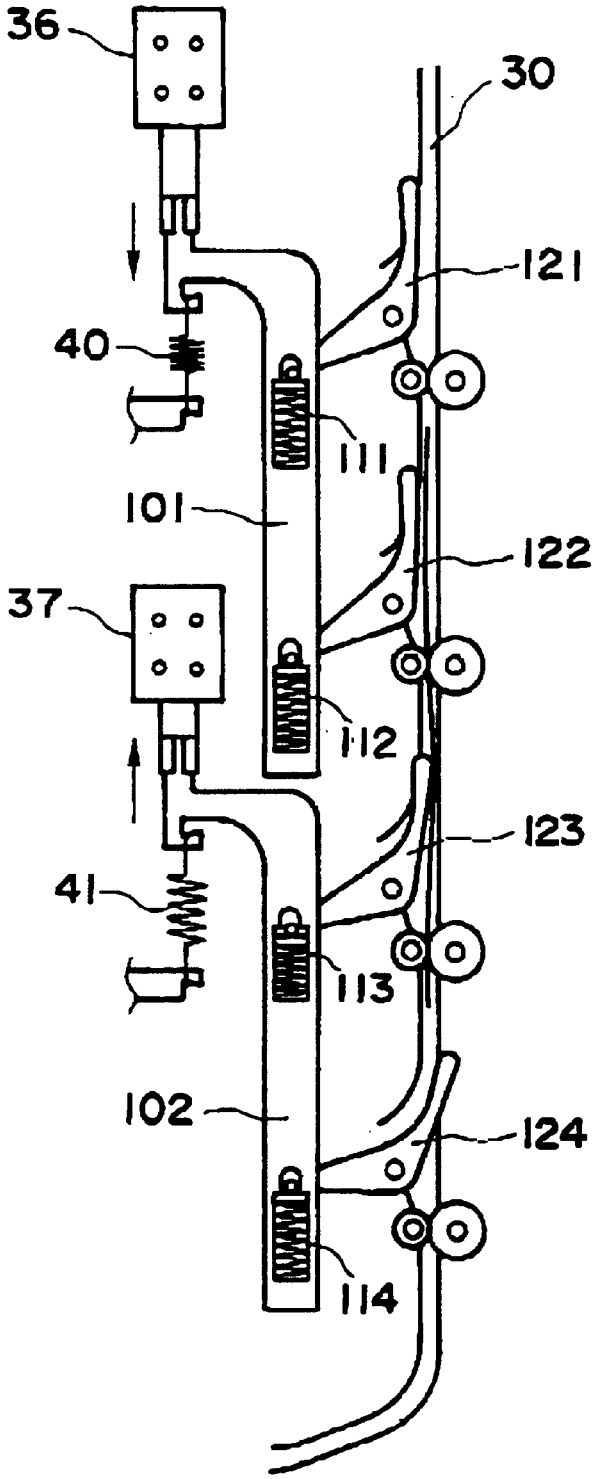
FIG. 8 is a vertical section of the essential portion of the sheet processing apparatus in the fourth embodiment of the present invention.
Figure 10:
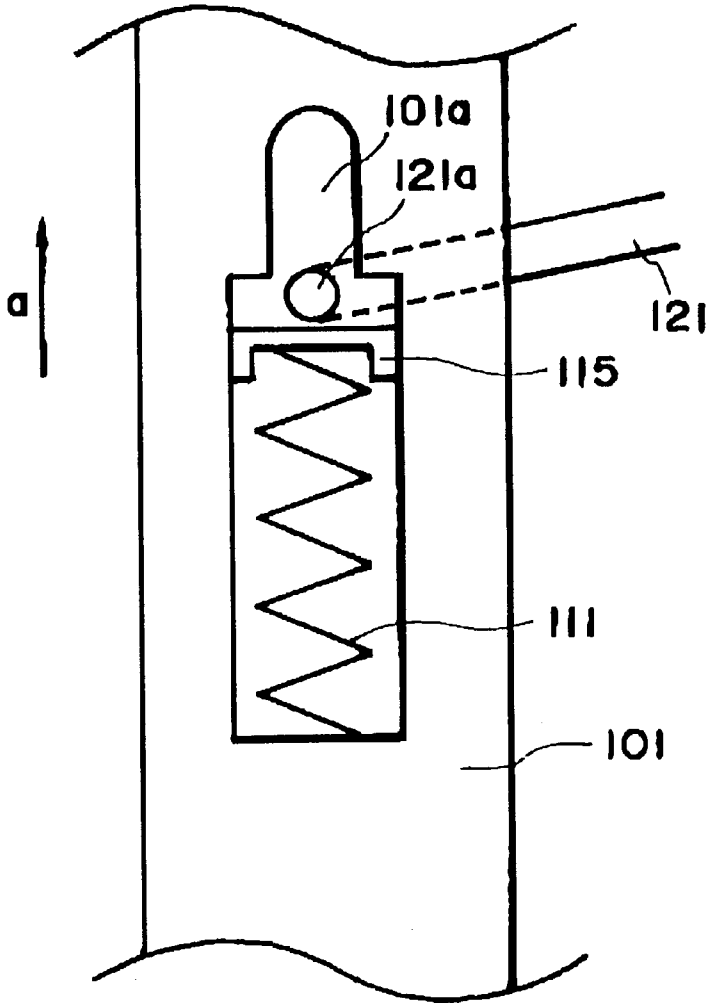
FIG. 10, is a longitudinal section of the compression spring, that is, one of the link members, and its adjacencies, in the sheet processing apparatus in the fourth embodiment of the present invention.
Figure 9:
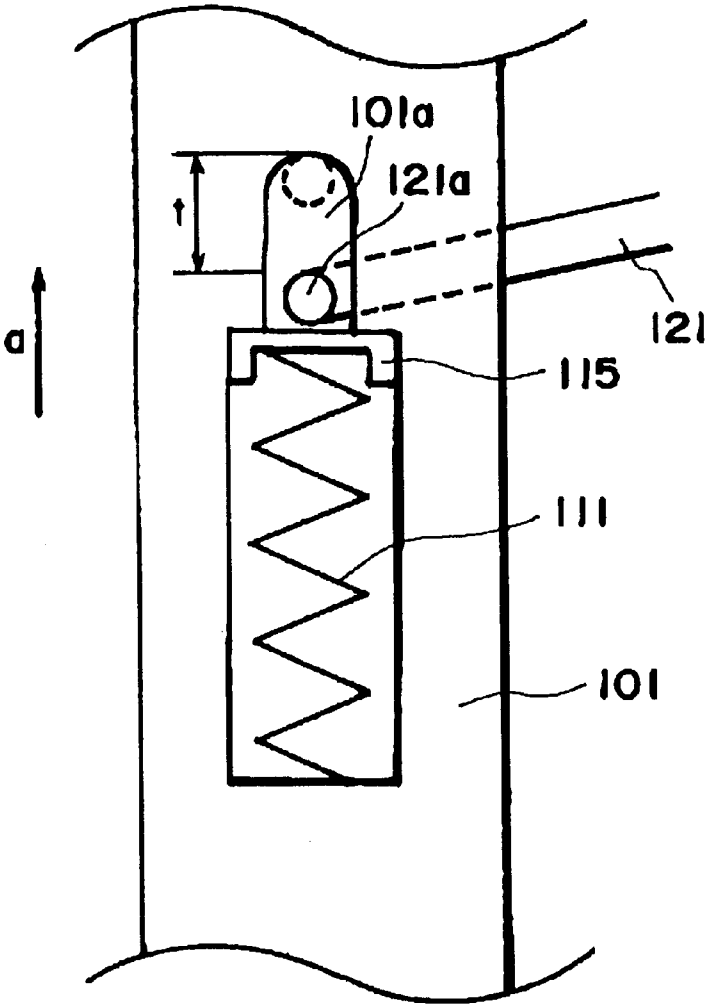
FIG. 9 is a longitudinal section of the compression spring, that is, one of the link members, and its adjacencies, in the sheet processing apparatus in the fourth embodiment of the present invention.

Referring to FIGS. 8 and 10, the sheet processing apparatus in the fourth embodiment will be described. FIG. 8 is an enlarged section of the essential portion of the sheet processing apparatus in this embodiment, and FIGS. 9 and 10 are sectional drawings which depict the conditions of a spring disposed in a link. Since the general structure of the apparatus is substantially the same as the first embodiment, the members and portions having the same functions are designated by the same referential symbols, and their detailed descriptions will be omitted here.

Referring to FIG. 8, the structure of the sheet processing apparatus in this embodiment is substantially the same as that in the first embodiment described above. It is different only in the configurations of links 101 and 102 which are moved by the solenoids 36 and 37, respectively, the configurations of flappers 121 and 124, and the characteristics of springs 111–114.

Referring to FIG. 9, the link 101 comprises a compression spring 111, and a cap 115 which holds one end of the compression spring 111. One end 121*a* of the flapper 121 is fitted in an engagement hole 101*a* of the link 101 with the provision of a gap (play) t. Although this is not illustrated here, the structures for engaging the link 101 with the flapper 122, and the link 102 with the flappers 123 and 124 are the same as the structure for engaging the link 101 with the flapper 121.

The state illustrated in FIG. 9 is a state in which the solenoid 36 is off. It can also be a state in which the solenoid 36 is on; the flapper 121 is blocking the common sheet path 30; and no sheet is in the common sheet path 30. The state illustrated in FIG. 10 is a state in which the solenoid 36 is on, a sheet is in the common sheet path 30, and the flapper 121 is in contact with the sheet in the common sheet path 30. With the provision of the above described structure, as the solenoid 36 is turned on, and the link 101 moves in the direction of an arrow mark a, the end 121*a* of the flapper 121 is lifted by the cap 115 as illustrated in FIG. 9. As a result, the flapper 121 is pivoted clockwise to a position at which it blocks the common sheet path 30. Regarding this movement of the flapper 121, when a sheet is in the common sheet path 30, the flapper 121 comes in contact with the sheet, and stops after pressing down the cap 115 as shown in FIG. 10.

Also in the case of the above described structure, the end 121*a* of the flapper 121 is fitted in the engagement hole 101*a* of the link 101 with the provision of the play t. Therefore, even if the solenoid 36 is turned off after a sheet is guided into one of the sheet delivery paths by the flapper 121, and the link 101 moves downward, the flapper 121 is allowed to remain where it is (at the position to which it has been moved by turning on the solenoid 36). More specifically, the end 121*a* of the flapper 121 moves to the uppermost end (position outlined by a broken line in FIG. 9) of the engagement hole 101*a* of the link 101, allowing the flapper 121 to remain blocking the common sheet path 30. As a result, the solenoid 36 can be turned off after a sheet begins to be guided by the flapper 121. Therefore, solenoid duty can be reduced. In other words, it is possible to employ inexpensive solenoids, which makes it possible to provide ah apparatus with far lower cost.

Embodiment 5

Figure 11:
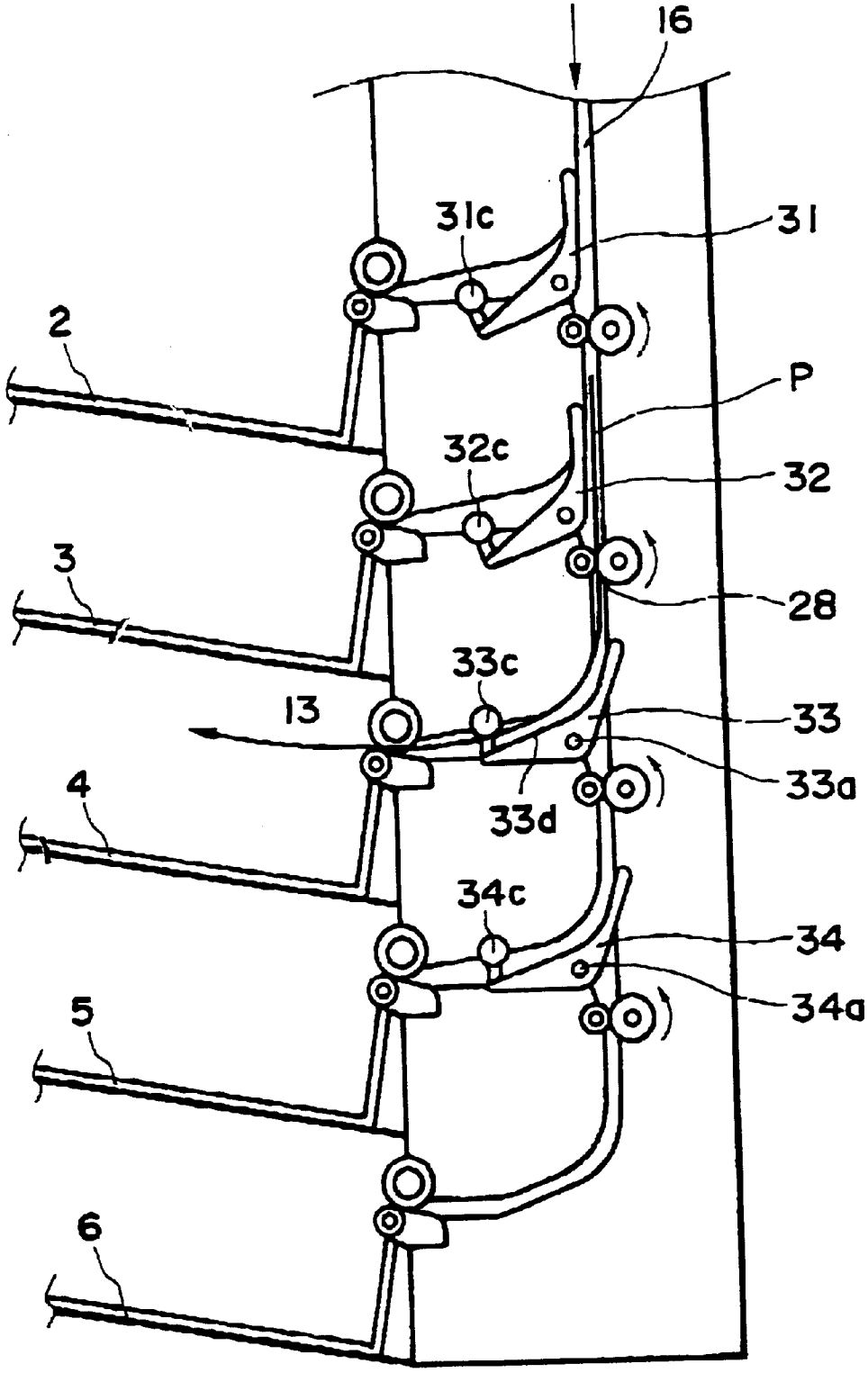
FIG. 11 is a vertical section of the flapper containing portion of the sheet processing apparatus in the second embodiment of the present invention.

FIG. 11 is a schematic section of the sheet path of the sheet sorting apparatus of the fifth embodiment of the present invention.

The structure illustrated in this drawing is the same as the structure described in the first embodiment, except that the configurations of the flappers 31, 32, 33 and 34 are different. As for the referential symbols, they are the same as the first embodiment except for those for the flappers.

The movement of the flapper 33 to discharge a sheet P into a delivery tray 4 will be described.

The flapper 33 comprises a guide portion 33*d*, and a retaining portion 33*c*. The guide portion 33*d* guides the downward facing surface of the sheet P, The retaining portion 33*c* is located at the downstream end of the guide portion 33*d*, relative to the sheet conveyance direction, and is disposed so as to be on the top surface side of the sheet P. The guide portion 33*d* and the retaining portion 33*c* are connected to each other outside the sheet path.

The sheet conveyance speed of a delivery roller pair 13 is set to be faster by a predetermined amount than that of a conveyer roller pair 28.

In order to deliver a sheet P into the third tray 4; the solenoid is turned on as soon as the leading end of the sheet P reaches the conveyer roller 28, so that the flapper 33 is pivoted to guide the sheet P toward the delivery roller 13. The sheet P is conveyed between the guide portion 33*d* and the retaining portion of the flapper 33.

As soon as the leading end of the sheet P is pinched by the nip of the delivery roller pair 13, the sheet P is pulled toward the delivery side due to the difference in sheet conveyance speed between the delivery roller pair 13 and the conveyer roller pair 28. As a result, the retaining portion 33*c* of the flapper 33 is subjected to such force that is generated by the tension of the sheet P in the direction to pushed up the sheet P; the flapper 33 is subjected to such force that works to pivot the flapper 33 in the clockwise direction about an axis 33*a*. In this condition, even if the solenoid is turned off, the flapper 33 maintains the position at which it guides the sheet P toward the delivery roller pair 13.

In the first embodiment, while a sheet P is guided toward the delivery roller side by a flapper, the solenoids 17 and 18 must be kept in the ON state. However, according to this embodiment, the solenoid may be turned off as soon as the leading end of the guided sheet reaches a delivery roller pair.

Therefore, the power application time for a solenoid can be shortened.

Embodiment 6

Figure 12:
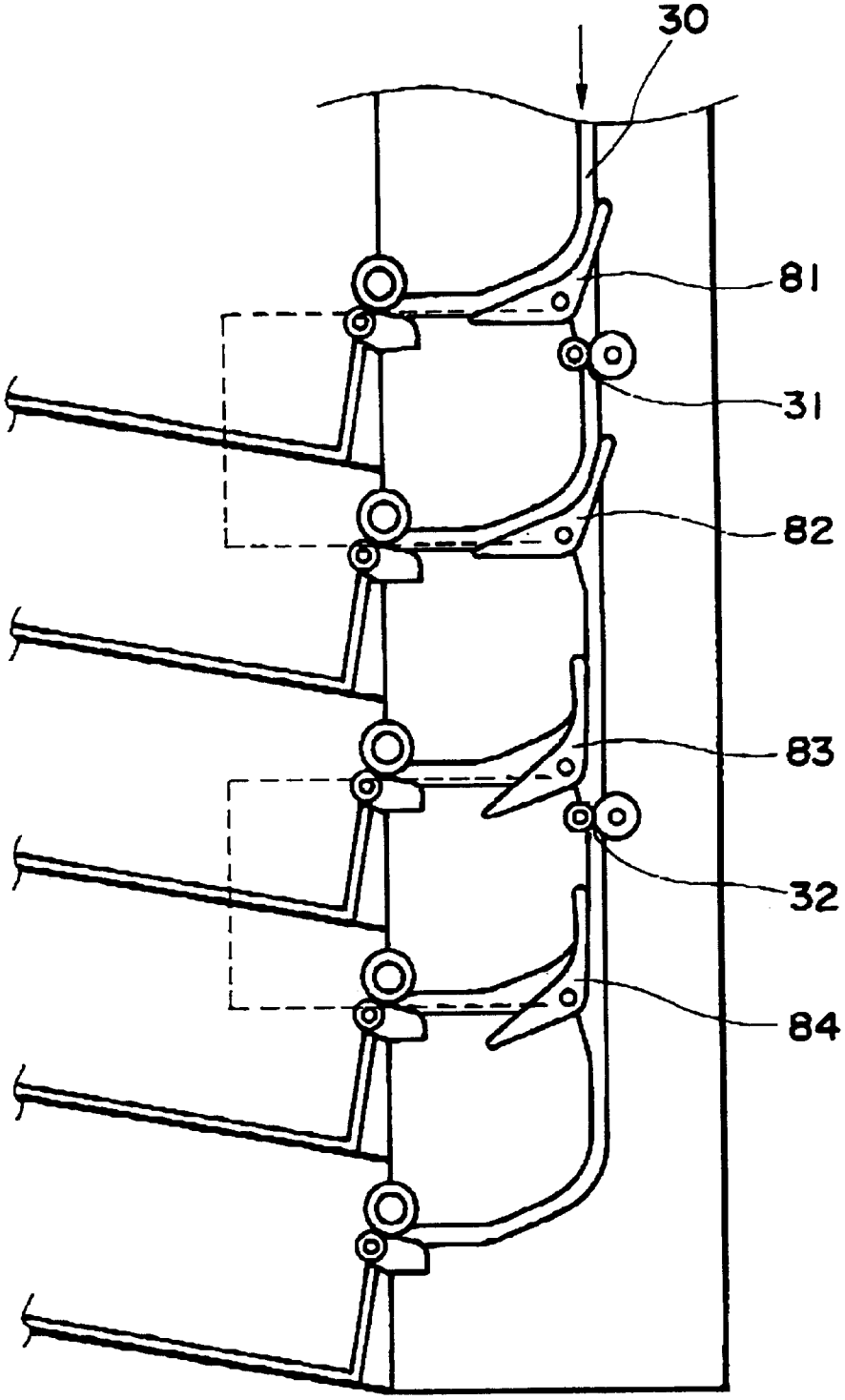
FIG. 12 is a vertical section of the essential portion of the sheet processing apparatus in the fifth embodiment of the present invention, depicting the flappers and the conveyer roller pairs.
Figure 13:
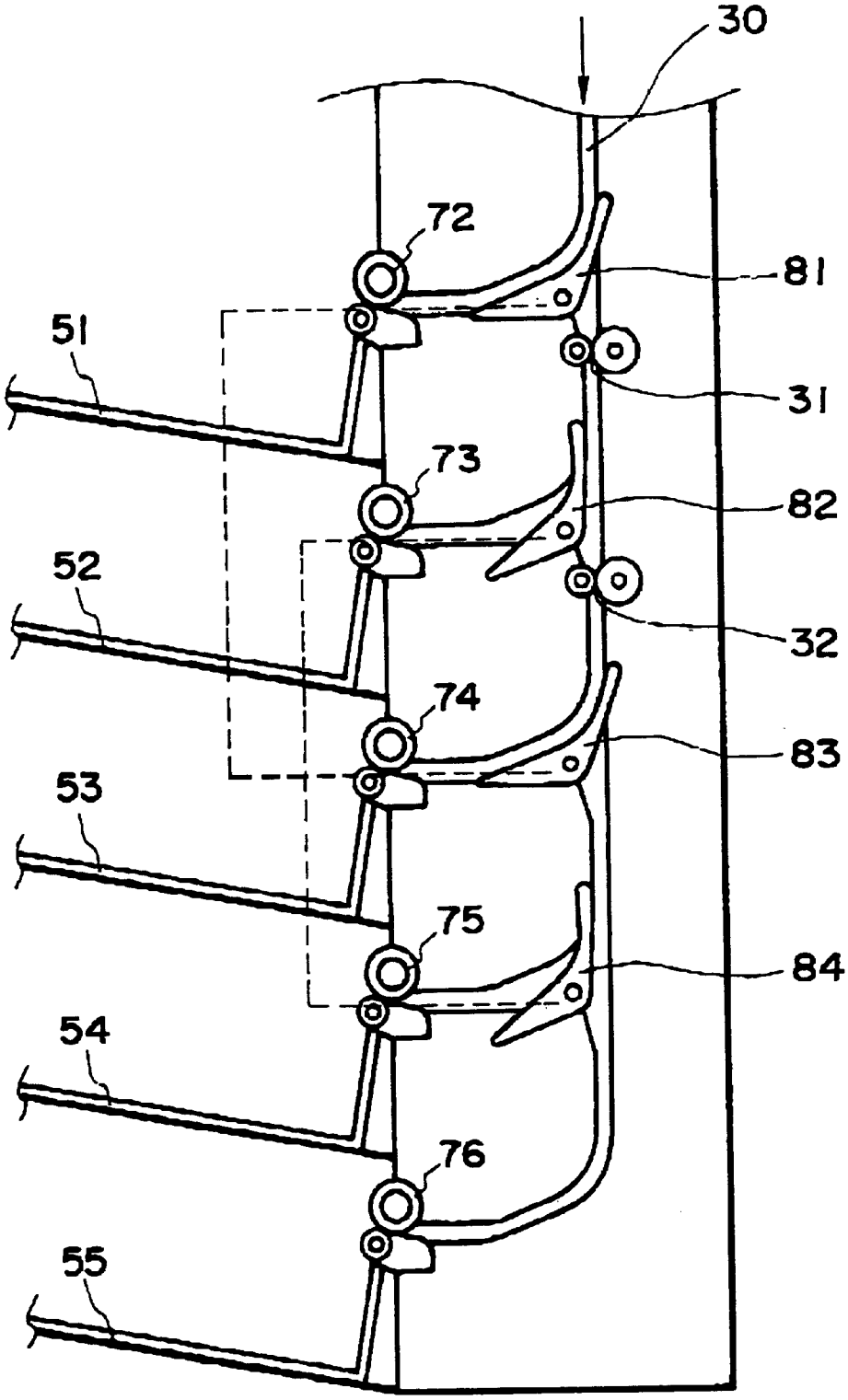
FIG. 13 is a vertical section of the essential portion of the sheet processing apparatus in the fifth embodiment of the present invention, depicting the flappers and the conveyer roller pairs.

FIGS. 12 and 13 are schematic sections of the sheet path portion of the sheet sorting apparatus in the sixth embodiment of the present invention.

In the case of the sheet sorting apparatus 1 illustrated in FIG. 12, two flappers which are moved by the same solenoid are flappers 81 and 82, which are adjacent to each other, and flappers 83 and 84, which also are adjacent to each other, as illustrated by a broken line. In the case of the sheet sorting apparatus 1 illustrated in FIG. 13, two flappers which are moved by the same solenoid are flappers 81 and 83, which are alternately positioned, and flappers 82 and 84, which also are alternately positioned, as indicated by a broken line. Also, at least one conveyer roller pair is necessary between the flappers moved by the same solenoid, as described in the first embodiment.

First, referring to FIG. 12, the positioning of the conveyer roller pair in an apparatus in which consecutively positioned flappers are moved by the same solenoid will be described.

A conveyer roller pair 31 is disposed along the common sheet path 30, between the first and second flappers 81 and 82 which are moved by the first solenoid. In order to guide a sheet toward the sheet delivery opening by the second flapper 82, the pivoting of the flappers 81 and 82 must be completed between the time when a sheet leaves the conveyer roller pair 31, and the time when the sheet reaches the flapper 82. Therefore, the conveyer roller pair 31 is disposed as close as possible to the first flapper 81. Similarly, the conveyer roller pair 32 is disposed between the third and fourth flappers 82 and 84, as close as possible to the third flapper 83.

Next, referring to FIG. 13, the positioning of the conveyer roller pair in an apparatus in which alternately positioned flappers are moved by the same solenoid will be described.

The conveyer roller pair 31 is disposed along the common sheet path 30, between the first and third flappers 81 and 83 which are moved by the first solenoid. In order to guide a sheet toward the sheet delivery opening by the third flapper 83, the pivoting of the third flapper 83 must be completed between the time when the sheet leaves the conveyer roller pair 31 and when it reaches the third flapper 83. Therefore, the conveyer roller pair 31 is disposed as close as possible to the first flapper 81.

When the conveyer roller pair 31 is on the upstream side of the second flapper, the distance from the conveyer roller pair 31 to the third flapper 83, that is, the distance through which a sheet is conveyed when the sheet is sorted by the third flapper, is long. Therefore, even when sheet conveyance speed is fast, the pivoting of the third flapper 83 can be reliably completed while the sheet is conveyed to the sorting portion of the third flapper after it reaches the conveyer roller pair 31.

Similarly, the conveyer roller pair 32 is disposed between the second and fourth flappers 82 and 84 which are moved by the second solenoid, immediately after the second flapper 82.

With the provision of the above structure, even when the measurement of the smallest conveyable sheet in the sheet conveyance direction is greater than the maximum distance between the nips of adjacent two conveyer roller pairs or adjacent two delivery roller pairs, the number of the conveyer roller pairs can be rendered smaller than that of the flappers.

Miscellaneous embodiments

Figure 14:
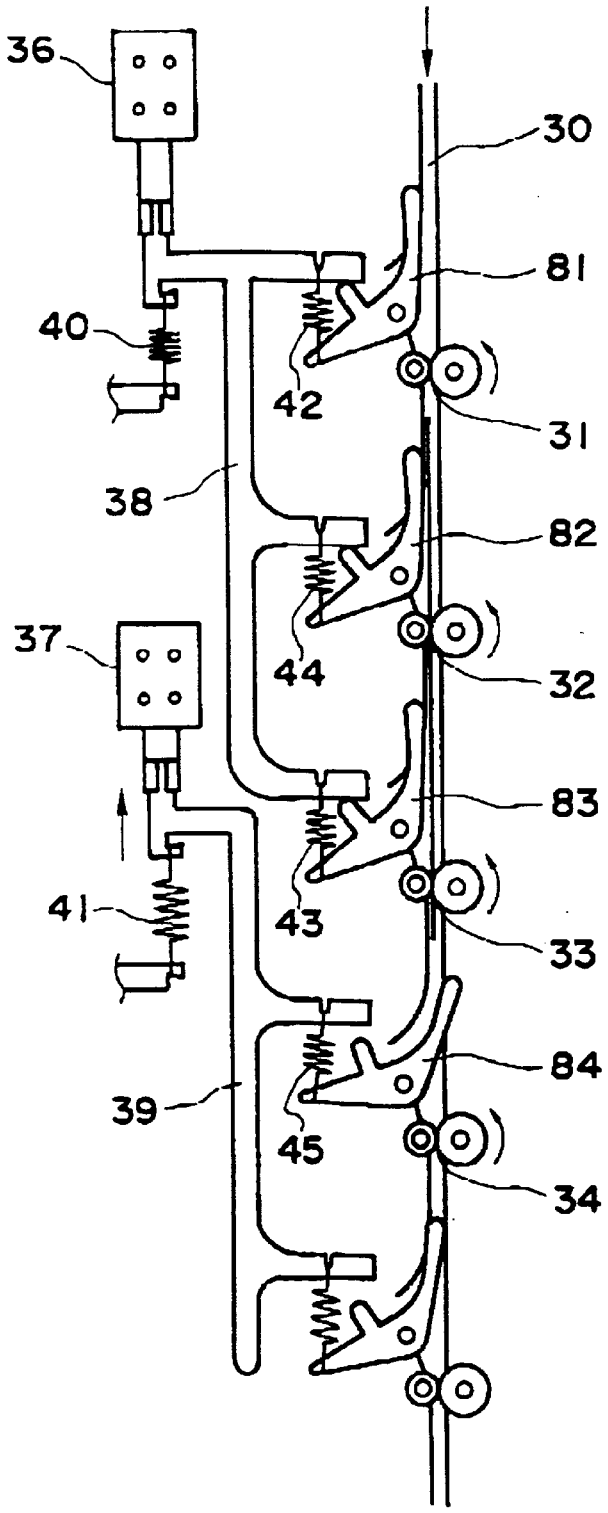
FIG. 14 is a vertical section of the essential portion of another embodiment of the present invention, depicting the flappers and the conveyer roller pairs.

In the preceding embodiments, the present invention was exemplified with reference to a sheet processing apparatus which moves two flappers at the same time with the use of a single solenoid, but the present invention is not to be limited by those embodiments. For example, three or more flappers (FIG. 14) may be moved at the same time using a single solenoid. Further, a unit comprising two flappers and a single solenoid, and a unit comprising three flappers and a single solenoid, may be mixedly employed.

Further, in the preceding embodiments, the present invention was exemplified by a sheet processing apparatus in which a spring such as a tension spring or a compression spring was employed as an elastic member. However, the present invention is not to be limited by those embodiments. For example, other elastic members such as rubber may be employed.

Further, the present invention is not to be limited to the embodiments described above. Links as connecting means, springs as elastic members, flappers as a pivotable member, may be modified in configuration, and also, their combination may be modified, to obtain the same effects.

Also in the embodiments described above, the present invention was exemplified by a sheet processing apparatus capable of sorting sheets into a plurality of optionally selected delivery trays. However, the present invention is not to be limited by those embodiments; the present invention is effectively applicable to a sheet processing apparatus provided with additional processing means such as a stapler capable of performing a stapling operation or the like on a set of sheets sorted into the delivery trays.

Further, in the embodiments described above, the present invention was exemplified by a sheet processing apparatus employed by an image forming apparatus in which an image is formed on the top surface of a sheet. However, the present invention is also effectively applicable to a sheet processing apparatus employed by an image forming apparatus in which an image is formed on the bottom surface of a sheet. In the latter case, a delivery tray into which a sheet is delivered without being turned over constitutes a face-down tray, and a tray into which a sheet is delivered after being turned over constitutes a face-up tray.

Further, in the embodiments described above, an image forming apparatus to which the present invention is applicable was exemplified by a copying machine combined with a reader or the like. However, the present invention is not to be limited by those embodiments. For example, an image forming apparatus may be in the form of a facsimile apparatus having a function to transmit or receive data, or an image outputting peripheral apparatus for an information processing device such as a computer. The same effects as those in the preceding embodiments can be also obtained by applying the present invention to a sheet processing apparatus employed in these image forming apparatuses.

Further, in the embodiments described above, a recording system employed by an image forming means was exemplified by an electrophotographic system. However, the present invention is not to be limited by those embodiments. For example, a recording system may be an ink jet system, a thermal transfer system, a thermal system, a wire dot system, or any other recording system. The same effects as those in the preceding embodiments can be obtained by applying the present invention to a sheet processing apparatus employed in an image forming apparatus which adopts one of these recording systems.

While the invention has been described with reference to the structures disclosed herein, it is not confined to the details set forth, and this application is intended to cover such modifications or changes as may come within the purposes of the improvements or the scope of the following claims.

What is claimed is:

1. A sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction, and an additional plurality of chancing means swung by additional common driving means, wherein said changing means are disposed alternately.

2. A sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction;

wherein said driving means have a solenoid, which is connected with a plurality of changing means through respective elastic members;

wherein said changing means are rotated by energizing said solenoid, and the sheet being transported along the passage is guided to said changing means, and wherein even if the solenoid is de-energized after a leading edge of the sheet reaches a downstream pair of rollers, said changing means remains at a position for blocking the passage as long as said changing means guides the sheet; and wherein said changing means is provided with a retaining portion member extended in a direction crossing with the sheet transporting direction, and wherein the sheet being guided is passed between said changing means and holding member, so that even if the solenoid is de-energized, the changing means remains at a position blocking the passage by tension force of a sheet acting on said retaining portion member.

3. A sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction, wherein a sheet transporting distance (M) from a position for blocking said passage by rotation of most upstream one, with respect to the sheet transporting direction, of said changing means actuatable by said driving means, to a pair of rollers which the sheet first reaches after the sheet is guided b a most downstream one of said changing means, is smaller than a sum of a length (L) of a minimum transportable sheet and a minimum sheet interval (H) during continuous sheet transportation ($M<L+H$).

4. An apparatus according to claim 3, wherein at least one pair of sheet transporting rollers for transportation the sheet is provided in each of spaces between adjacent changing means driven by the same driving means.

5. An apparatus according to claim 3, wherein said pair of rollers between adjacent changing means driven by the same driving means, is close to the upstream changing means.

6. A sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction;

wherein said driving means have a solenoid, which is connected with a plurality of changing means through respective elastic members; and wherein said elastic member is a spring having a tension stronger than a resistance against swinging motion of said changing means, and is weaker than the rigidity of the sheet.

7. An apparatus according to claim 6, wherein said elastic member is a spring not having initial tension, and said changing means is fixed to connecting means at a neutral position between a tension load position and compression load position.

8. An apparatus according to claim 7, wherein said changing means is engaged with said connecting means with a space therebetween.

9. A sheet sorter comprising:

a sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction;

a bin tray for accommodating the sheet passed through a passage changed by said changing apparatus; and an additional plurality of changing means swung by additional common driving means;

wherein said swingable changing means and said additional changing means are disposed alternatively.

10. A sheet sorter comprising:

a sheet passage changing apparatus comprising:

a plurality of swingable changing means for changing a sheet transporting direction;

common driving means for swinging said plurality of changing means; and control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction; and a bin tray for accommodating the sheet passed through a passage changed by said changing apparatus, wherein said driving means has a solenoid, which is connected with a plurality of changing means through respective elastic members, wherein said changing means are rotated by energizing said solenoid, and the sheet being transported along the passage is guided to said changing means, and wherein even if the solenoid is de-energized after a leading edge of the sheet reaches a downstream pair of rollers, said changing means remains at a position for blocking the passage as long as said changing means guides the sheet, and wherein said changing means is provided with a retaining portion extended in a direction crossing with the sheet transporting direction, and wherein the sheet being guided is passed between said changing means and said retaining portion, so that even if the solenoid is de-energized, the changing means remains at a position blocking the passage by tension force of a sheet acting on said retaining portion.

11. A sheet sorter comprising:

a sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction; and a bin tray for accommodating the sheet passed through a passage changed by said changing apparatus, wherein a sheet transporting distance (M) from a position for blocking said passage by rotation of most upstream one, with respect to the sheet transporting direction, of said changing means actuatable by said driving means, to a pair of rollers which the sheet first reaches after the sheet is guided by a most downstream one of said changing means, is smaller than a sum of a length (L) of a minimum transportable sheet and a minimum sheet interval (H) during continuous sheet transportation ($M<L+H$).

12. A sheet sorter according to claim 11, wherein at least one pair of sheet transporting rollers for transportation the sheet is provided in each of spaces between adjacent changing means driven by the driving means.

13. A sheet sorter according to claim 12, wherein said pair of transporting rollers between adjacent changing means driven by the driving means, is close to the upstream changing means.

14. A sheet sorter comprising:

a sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction; and a bin tray for accommodating the sheet passed through a passage changed by said changing apparatus, wherein said driving means has a solenoid, which is connected with a plurality of changing means through respective elastic members; and wherein said elastic member is a spring having a tension stronger than a resistance against swinging motion of said changing means, and is weaker than the rigidity of the sheet.

15. A sheet sorter according to claim 14, wherein said elastic member is a spring not having initial tension, and said changing means is fixed to connecting means at a neutral position between a tension load position and compression load position.

16. A sheet sorter according to claim 15, wherein said changing means is engaged with said connecting means with a space therebetween.

17. An image forming apparatus comprising:

a sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction;

an image forming station;

means for transporting a sheet on which said image forming means has formed an image to said sheet passage changing apparatus;

tray means, disposed opposed to the changing means of said sheet passage changing apparatus, for accommodating the sheet; and an additional plurality of changing means swung by additional common driving means, wherein said swingable changing means and said additional changing means are disposed alternatively.

18. An image forming apparatus comprising:

said sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction;

an image forming station;

means for transporting a sheet on which said image forming means has formed an image to said sheet passage changing apparatus; and tray means, disposed opposed to the changing means of said sheet passage changing apparatus, for accommodating the sheet, wherein said driving means has a solenoid, which is connected with a plurality of changing means through respective elastic members, wherein said changing means are rotated by energizing said solenoid, and the sheet being transported along the passage is guided to said changing means, and wherein even if the solenoid is de-energized after a leading edge of the sheet reaches a downstream pair of rollers, said changing means remains at a position for blocking the passage as long as said changing means guides the sheet, and wherein said changing means is provided with a retaining portion extended in a direction crossing with the sheet transporting direction, and wherein the sheet being guided is passed between said changing means and said retaining portion, so that even if the solenoid is de-energized, the changing means remains at a position blocking the passage by tension force of a sheet acting on said retaining portion.

19. An image forming apparatus comprising:

said sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction;

an image forming station;

means for transporting a sheet on which said image forming means has formed an image to said sheet passage changing apparatus; and tray means, disposed opposed to the changing means of said sheet passage changing apparatus, for accommodating the sheet, wherein a sheet transporting distance (M) from a position for blocking said passage by rotation of most upstream one, with respect to the sheet transporting direction, of said changing means actuatable by said driving means, to a pair of rollers which the sheet first reaches after the sheet is guided by a most downstream one of said changing means, is smaller than a sum of a length (L) of a minimum transportable sheet and a minimum sheet interval (H) during continuous sheet transportation ($M < L + H$).

20. An image forming apparatus according to claim 19, wherein at least one pair of sheet transporting rollers for transportation the sheet is provided in each of spaces between adjacent changing means driven by the driving means.

21. An image forming apparatus according to claim 20, wherein said pair of transporting rollers between adjacent changing means driven by the driving means, is close to the upstream changing means.

22. An image forming apparatus comprising:

said sheet passage changing apparatus comprising:

a plurality of swingable changing means for changing a sheet transporting direction;

common driving means for swinging said plurality of changing means;

control means for actuating said driving means, before a sheet reaches an upstream one of said changing means, to actuate said upstream one of said changing means, thus changing the sheet transporting direction and for actuating driving means, after the sheet passing through said upstream changing means and before the sheet reaches a downstream one of said changing means, to actuate said downstream changing means, thus changing the sheet transporting direction;

an image forming station;

means for transporting a sheet on which said image forming means has formed an image to said sheet passage changing apparatus; and tray means, disposed opposed to the changing means of said sheet passage changing apparatus, for accommodating the sheet, wherein said driving means has a solenoid, which is connected with a plurality of changing means through respective elastic members, and wherein said elastic member is a spring having a tension stronger than a resistance against swinging motion of said changing means, and is weaker than the rigidity of the sheet.

23. An image forming apparatus according to claim 22, wherein said elastic member is a spring not having initial tension, and said changing means is fixed to connecting means at a neutral position between a tension load position and compression load position.

24. An image forming apparatus according to claim 22, wherein said changing means is engaged with connecting means with a space therebetween.

25. A sheet sorter according to claim 10, wherein the downstream pairs of rollers are discharging rollers, opposed to the bin tray, for discharging the sheet to said bin tray.

26. An image forming apparatus according to claim 18, wherein the downstream pairs of rollers are discharging rollers, opposed to the bin tray, for discharging the sheet to said bin tray.

27. A sheet sorter according to claim 9, further comprising reversing rollers for switching back the sheet and reversing a feeding direction of the sheet.

28. An image forming apparatus according to claim 17, further comprising reversing rollers for switching back the sheet and reversing a feeding direction of the sheet.

29. A sheet passage changing apparatus comprising:

a plurality of swingable changing means for changing a sheet transporting direction;

first driving means for swinging a first group of said plurality of changing means;

second driving means for swinging a second group of said plurality of changing means; and control means for selectively actuating said first driving means and second driving means, wherein said first group of said plurality of changing means and said second group of said plurality of changing means are disposed alternately.

30. A sheet sorter comprising:

a sheet passage changing apparatus which comprises:

a plurality of swingable changing means for changing a sheet transporting direction;

first driving means for swinging a first group of said plurality of changing means;

second driving means for swinging a second group of said plurality of changing means;

a bin tray for accommodating the sheet passed through a passage changed by said first group of said plurality of changing means or said second group of said plurality of changing means; and control means for selectively actuating said first driving means and second driving means, wherein said first group of said plurality of changing means and said second group of said plurality of changing means are disposed alternately.

* * * * *

UNITED STATES PATENT AND TRADEMARK OFFICE

CERTIFICATE OF CORRECTION

PATENT NO. : 6,206,369 B1
DATED : March 27, 2001
INVENTOR(S) : Osamu Hoshii et al.

It is certified that error appears in the above-identified patent and that said Letters Patent is hereby corrected as shown below:

Column 2,
Line 5, "(cost" should read -- cost --.

Column 4,
Line 50, "sama" should read -- same --.

Column 5,
Line 47, "roller" should read -- roller 16. --.

Column 7,
Line 31, "coining" should read -- coming --.

Column 8,
Line 41, "an" should read -- a --.
Line 61, "reach" should read -- each --.

Column 9,
Line 19, "and" (1st occurrence) should read -- end --.
Line 32, "an" should read -- on --.
Line 67, "and" should read -- and --.

Column 10,
Line 29, "deliverer" should read -- delivery --.
Line 47, "provide" should read -- to provide --.

Column 13,
Line 59, "ah" should read -- an --.

Column 14,
Line 28, "pushed" should read -- push --.

Column 16,
Line 56, "chancing" should read -- changing --.

UNITED STATES PATENT AND TRADEMARK OFFICE

CERTIFICATE OF CORRECTION

PATENT NO. : 6,206,369 B1
DATED : March 27, 2001
INVENTOR(S) : Osamu Hoshii et al.

It is certified that error appears in the above-identified patent and that said Letters Patent is hereby corrected as shown below:

Column 17,
Line 45, "b" should read -- by --.
Line 51, "transportion" should read -- transportation of --.

Column 19,
Line 40, "transportation" should read -- transportation of --.

Column 21,
Line 45, "transportation" should read -- transportation of --.

Signed and Sealed this

Eighth Day of January, 2002

*Attest:*

*Attesting Officer*

JAMES E. ROGAN
*Director of the United States Patent and Trademark Office*